US008757609B2

(12) United States Patent
Dalal et al.

(10) Patent No.: US 8,757,609 B2
(45) Date of Patent: Jun. 24, 2014

(54) QUICK CHANGE DIGITAL LABEL PRESS

(75) Inventors: Edul N. Dalal, Webster, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 181 days.

(21) Appl. No.: 13/398,983

(22) Filed: Feb. 17, 2012

(65) Prior Publication Data

US 2013/0215207 A1 Aug. 22, 2013

(51) Int. Cl.
*B31F 5/00* (2006.01)
*B65H 39/14* (2006.01)

(52) U.S. Cl.
USPC ..... 270/52.13; 270/1.01; 270/5.02; 156/552; 156/556; 156/562

(58) Field of Classification Search
USPC ..... 270/1.01, 5.02, 52.07, 52.13; 347/110; 281/2, 5; 156/184, 269, 60, 443, 446, 156/238, 384, 387, 552, 556, 557, 560, 562, 156/566; 53/128.1
See application file for complete search history.

(56) References Cited

U.S. PATENT DOCUMENTS

| | | | | |
|---|---|---|---|---|
| 4,334,672 | A * | 6/1982 | Felix | 270/52.13 |
| 4,397,709 | A * | 8/1983 | Schwenzer | 156/351 |
| 4,680,080 | A * | 7/1987 | Instance | 156/357 |
| 4,959,115 | A | 9/1990 | Lacy | |
| 5,044,669 | A | 9/1991 | Berry | |
| 5,324,153 | A | 6/1994 | Chess | |
| 5,863,628 | A | 1/1999 | Barry | |
| 6,032,004 | A | 2/2000 | Mirabella, Jr. et al. | |
| 6,641,684 | B2 * | 11/2003 | Instance | 156/64 |
| 6,769,541 | B1 | 8/2004 | Carriere | |
| 6,932,135 | B2 * | 8/2005 | Tabuchi | 156/518 |
| 7,798,192 | B2 * | 9/2010 | Crum | 156/446 |
| 2006/0228508 | A1 | 10/2006 | Flynn et al. | |

* cited by examiner

*Primary Examiner* — Leslie A Nicholson, III
(74) *Attorney, Agent, or Firm* — Gibb & Riley, LLC

(57) ABSTRACT

An integrated apparatus comprises a sheet supply maintaining cut sheets of media and a printing device positioned to receive the cut sheets of media from the sheet supply. The sheet supply may comprise a plurality of sheet feeders. The printing device places markings on the cut sheets of media. Further, this apparatus includes an adhesive applicator positioned to apply adhesive to one side of the sheets to produce labels; and a roll apparatus maintaining a continuous supply roll of backing media. The roll apparatus is positioned to receive the labels from the adhesive applicator, and the backing media is positioned within the roll apparatus to contact the adhesive-applied side of the labels.

19 Claims, 5 Drawing Sheets

QUICK CHANGE DIGITAL LABEL PRESS

BACKGROUND

Embodiments herein generally relate to label printing and more particularly to a structure that produces finished rolls of labels from cut sheets.

Label converting (printing, die-cutting, coating, etc.) is a large and healthy world-wide market. Label printing has traditionally been done by "analog" methods—mainly flexography, but also gravure and offset. However, in recent years, a number of digital label presses have become available. These presses were first based on electro-photography but more recently several ultraviolet (UV) inkjet label presses have been introduced.

Pressure-sensitive (PS) labels are by far the primary focus of digital label presses. A pressure-sensitive label can be a three-layer lamination consisting of label substrate, adhesive, and liner/backing media. The pressure sensitive laminate is typically purchased by the converter, who prints the labels, die cuts, and removes the waste trim from around the label. The fully converted and finished roll stock of labels is then sent to the end user. In the label machine, the labels are peeled off the liner by passing over a peel plate, and applied directly to, for example, a product container. Pressure-sensitive labels are used broadly in all market segments, and are a dominant component of the "prime label" market.

Analog methods such as flexography have relatively low run cost, but the setup costs, including flexography plate preparation, is expensive. Consequently, the analog methods are cost-effective for long runs but very expensive for short runs. The advantage of digital label presses is that they do not require plates and the setup costs are lower, so they are the preferred alternative for short run jobs.

However, the setup costs of current digital label presses are sufficiently high to make very short runs extremely expensive. For very short runs (e.g., 100 labels) of small labels, the setup costs to the end-user are almost 100% of the total cost, even for digital label presses. So there is only a small window of opportunity for the digital label presses, being limited at the short run end by setup costs, and at the long run end by the lower run costs of analog presses such as flexography.

One obstacle to significantly reducing the setup cost of digital label presses is the substrate changeover activity. Digital label presses are mostly roll-to-roll machines, since the finished labels are applied to the containers using roll-fed machines, and even manually applied labeling operations often utilize a dispenser, which requires a roll of labels. A typical label converter offers a large variety (dozens) of label substrates, including many types of coated and uncoated and metalized papers as well as white, clear and metalized films of biaxially oriented polypropylene (BOPP), polyester, vinyl, etc. In addition, each of these substrates can be provided with different types of adhesives. Consequently, although job management software facilitates batching jobs to reduce changeovers, substrate changes between jobs are common. And because these substrates are roll-fed, the changeover takes time and labor, in addition to idling the press and thereby reducing productivity.

SUMMARY

A digital label press architecture is presented below, where label substrates are input as cut sheets and the printed labels are output on a roll. This is accomplished by feeding the label substrate, marking the label substrate, adding glue to the back of the substrate and merging the label substrate with a roll of liner material. These systems can optionally also translate a set of backing media rolls having different backing media types or widths so that an optimal backing media type or width can be utilized for a given label-printing job.

An exemplary integrated apparatus herein comprises a sheet supply maintaining cut sheets of media and a printing device positioned to receive the cut sheets of media from the sheet supply. The printing device places markings on the cut sheets of media. Further, this apparatus includes an adhesive applicator positioned to apply adhesive to one side of the media to produce the labels; and a roll apparatus maintaining a continuous supply roll of backing media. The roll apparatus is positioned to receive the labels from the adhesive applicator, and the backing media is positioned within the roll apparatus to contact the adhesive-applied side of the labels.

Another exemplary apparatus herein also comprises a sheet supply that maintains sheets of media. The sheet supply comprises a number of sheet feeders potentially containing different types of the sheets of media. A processor is operatively (meaning directly or indirectly) connected to the sheet supply. The processor receives different print jobs. Some of the different print jobs remove different types of sheets of media from the different sheet feeders. Further, the processor causes this to happen continuously for each successive print job, without manual intervention for setup operations between each successive print job.

A digital printing device is also operatively connected to the processor and is positioned to receive the sheets of media from the sheet supply. The digital printing device places markings on the sheets of media to produce printed labels. Again, the processor controls the digital printing device to print each successive print job continuously, also without manual intervention for setup operations between each successive print job.

Further, a cutter can be operatively connected to the processor. The cutter cuts the sheets of the printed labels into individual labels as controlled by the processor (again, continuously for each successive print job, also without manual intervention for setup operations between each the successive print job). The cutter can cut different patterns for each successive print job, similarly without manual intervention for setup operations between each successive print job. The cutter can be positioned between the digital printing device and the adhesive applicator to cut the sheets of the printed labels before the individual labels are supplied to the adhesive applicator, or the cutter can be positioned adjacent the roll apparatus to cut the sheets of the printed labels after the individual labels are attached to the backing media. The cutter may be, for example, a laser cutter or a plotter-type cutter, or may comprise a turret assembly containing a plurality of cutting dies.

An adhesive applicator is positioned to apply adhesive to one side of the printed labels. (e.g., what can be arbitrarily referred to as the back of the printed labels). The adhesive applicator can contact the back of the printed labels, or can be a spray applicator that sprays the adhesive on the back of the printed labels.

Further, a roll apparatus is positioned to receive the printed labels from the adhesive applicator. The roll apparatus maintains one or more continuous supply rolls of backing media. The roll apparatus can position one of the continuous supply rolls of backing media (if equipped with multiple backing rolls) to receive the printed labels from the adhesive applicator continuously for each successive print job, without manual intervention for setup operations between each successive print job, as controlled by said processor. The roll apparatus positions the backing media to contact the back of the printed labels. The roll apparatus can further comprise a pressure roller or a blade that is positioned to press the labels against the backing media. The roll apparatus has a take-up roll support maintaining a continuous roll of the printed labels attached to the backing media.

Thus, the structure includes a plurality of rolls of backing media and a shifting device positioning a selected roll of backing media into a position to receive the media from the adhesive applicator. Further, the plurality of rolls of backing media can be different widths, different types, and/or of different materials, and a controller automatically selects and positions the appropriate roll of backing media depending on the size and/or the application requirements of the labels being printed. The application requirements are typically defined by the end-user of the labels, and includes, without limitation, factors such as cost, break-resistance, die-cutter robustness, label machine requirements, environmental considerations including recyclability, etc.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
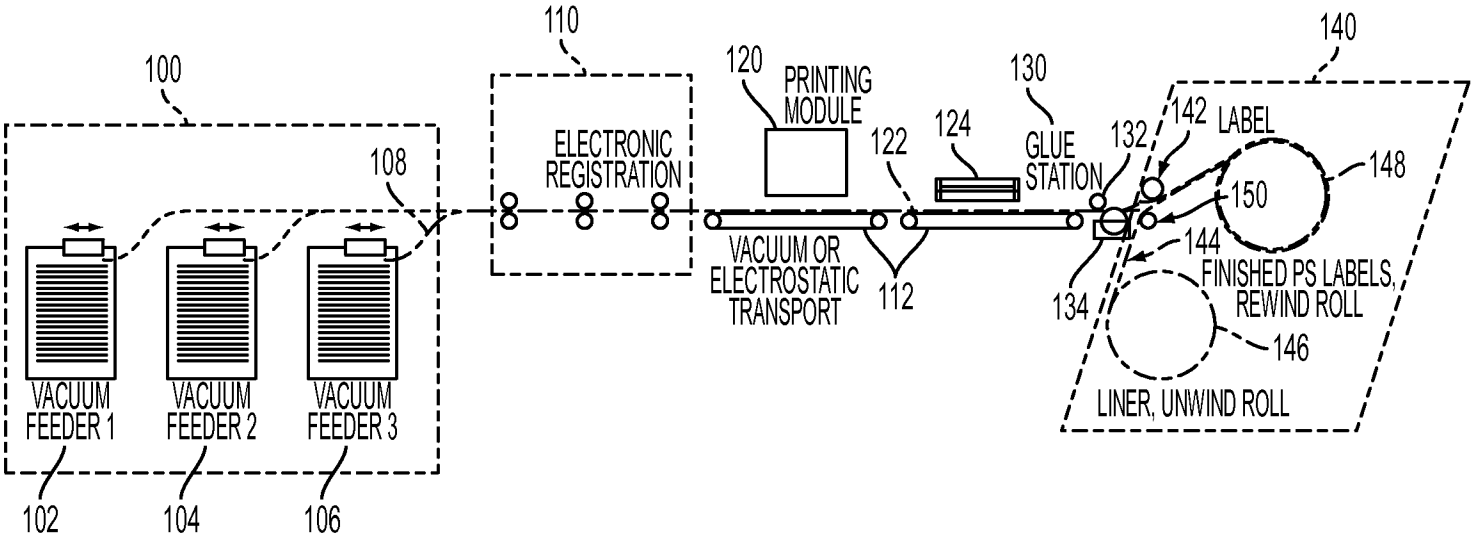
FIG. 1 is a side-view schematic diagram of a device according to embodiments herein.

As mentioned above, digital label presses are currently limited in their productivity and cost-effectiveness due to the high cost of substrate changeovers between jobs. In view of such issues, the devices disclosed herein provide digital label press architectures as shown, for example, in FIGS. 1-4. With the devices herein, the label substrates 108 are input as cut sheet from different sheet feeders 102-106 and the printed labels 122 are output on a roll 148. The devices herein are able to quickly and effortlessly switch substrates, yet are compatible with the end user's labeling workflow because the output labels 122 are roll-based.

Such presses permit multiple different substrate materials to be loaded in separate feeders 102-106, as is commonly done for cut-sheet document presses. In one embodiment, a relatively small number of feeders (e.g., 4) can be used, and each feeder can be replenished with the next required substrate while the press is operating from the other feeders.

In one embodiment, the cut-sheet feeders 102-106 in the sheet feeder apparatus 100 could contain the substrate material only (no liner or adhesive). The sheets 108 are fed through a media path, which includes vacuum feeder, electronic registration 110 and a vacuum or electrostatic hold-down transport in the print zone 112. After printing by the printing module 120, the adhesive unit 130 applies adhesive to the back of the labels 122. A roll adhesive application system 130 having a roll contact applicator 134 and an opposing bias roller 132 is shown; however, it should be appreciated that other adhesive application devices such as spray systems are also intended to be illustrated by item 130. Further, any adhesive, whether currently known or developed in the future can be used with the devices discussed herein.

The labels 122 that have been printed are attached to the liner/backing media 144. More specifically, the backing media 144 is drawn from a continuous roll 146 within the roll apparatus 140, and moved across a tensioning roller 150. The labels 122 are pressed onto the backing media 144 by a pressure roller or a blade 142, and the combination of labels 122, adhesive, and backing media 144 are wound upon a finished label roll 148.

Since some of the substrates 108 utilized with these systems can be quite thin, and the feeder 100 and transport design parameters are generally optimized for thin media to ensure robust operation. Also, the use of the electronic registration system 110 enables deskew and lateral registration of thin media.

Item 124 is used to generically represent a number of devices that could be used with the devices described herein. In one example, item 124 could be a curing device if the printing module 120 is a UV cured printing element. Alternatively, item 124 can represent an optional cutter, which may be positioned at many different locations of the paper path, such as between the digital printing device 120 and the adhesive applicator 130 to cut the sheets 108 of the printed labels 122 before the individual labels 122 are supplied to the adhesive applicator 130, or the cutter 124 can be positioned adjacent the roll apparatus 140 to cut the sheets 108 of the printed labels 122 after the individual labels 122 are attached to the backing media. Alternatively, the cutter 124 may be used later in the label converting process and not included in this device.

This architecture permits high-speed substrate changeover, without stopping the press and/or without manual intervention. For purposes herein, manual intervention is activity performed by a user. Once processing is started by the user, the systems and methods herein operate automatically to produce multiple types and sizes of labels on different substrate rolls, without requiring any additional user activity or input. Since the devices described herein do not reduce press productivity, even a slower press speed can potentially provide higher label throughput relative to a current architecture (roll-to-roll design) that experiences time delays during substrate change setup periods. Moreover, labels 122 can be printed N-up and then slit post-printing. This minimizes the need to change the width of the roll media.

Figure 2:
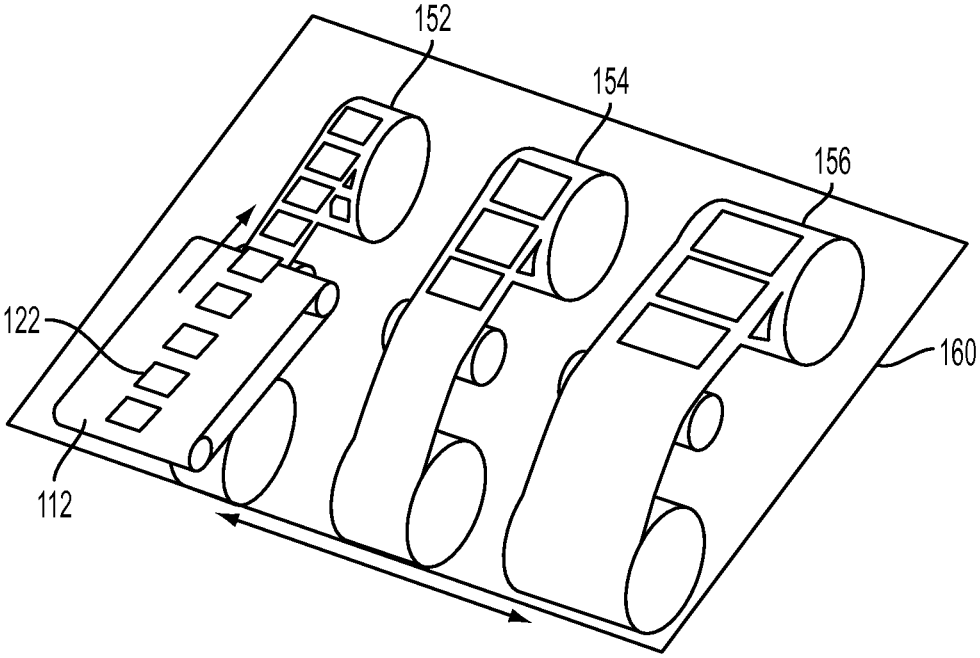
FIG. 2 is a side-view schematic diagram of a device according to embodiments herein.

Multiple backing media roll widths, and even multiple backing media types, may sometimes be used. Therefore, as shown in FIG. 2, the roll apparatus 140 can include a translating carriage 160 holding multiple backing media rolls 152-156 having different widths or types of backing media. With the shifting structure shown in FIG. 2, a different backing substrate 152-156 can be moved adjacent to the label transport 112 so that labels can be attached to one of the different backing substrates 152-156, depending upon the width of the labels 122 or the width of pattern of labels 122 being produced, or depending upon the type of backing media desired. This ensures that fully automated non-stop operation can be maintained, with no need to manually change backing media rolls, even over a wide range of label sizes.

Thus, the structure includes a plurality of rolls of backing media and a shifting device positioning a selected roll of backing media into a position to receive the media from the adhesive applicator. Further, the plurality of rolls of backing media can be different widths, different types, and/or of different materials, and a controller automatically selects and positions the appropriate roll of backing media depending on the size and/or the application requirements of the labels being printed.

Figure 3:
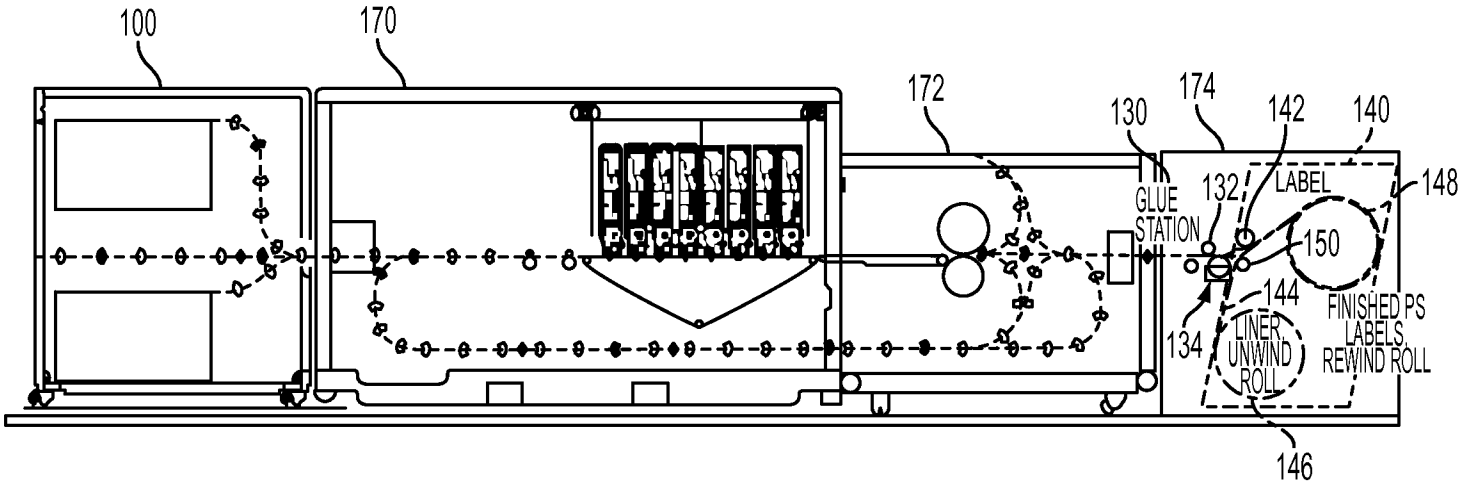
FIG. 3 is a side-view schematic diagram of a device according to embodiments herein.

In addition, while FIG. 1 illustrates the apparatus herein as a single integrated device, the adhesive applicator apparatus 130 and the roll apparatus 140 could be included in a module 174 that is part of a modular printing system, as shown in FIG. 3. Thus, for a limited media range, the structures disclosed herein can also be utilized with a modular printing device that may include a feeder module 100, an image output terminal 170, a finishing device 172, etc. This separate label module 174 accepts the printed label stock, adds adhesive and merges the media with a roll of liner. The module can optionally include more than one width of liner roll media as described above.

Figure 4:
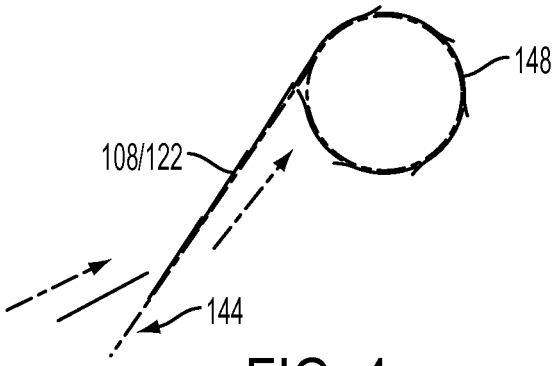
FIG. 4 is a side-view schematic diagram of a device according to embodiments herein.

Further, as shown in FIG. 4, the systems herein can slightly partially overlap sheets 108 on the liner 144. This facilitates removing waste sections more easily because the overlap section can be more easily removed by the downstream cutter, such as a die-cutter. In the cutter, the outline of the labels is cut but not the liner, and then the remaining waste material surrounding the labels is peeled off and discarded. If this is done with separate sheets attached to a liner, it is not easy to continuously peel off the waste material. Therefore, the slight overlap shown in FIG. 4, results in a continuous web which can be peeled off intact.

Figure 5:
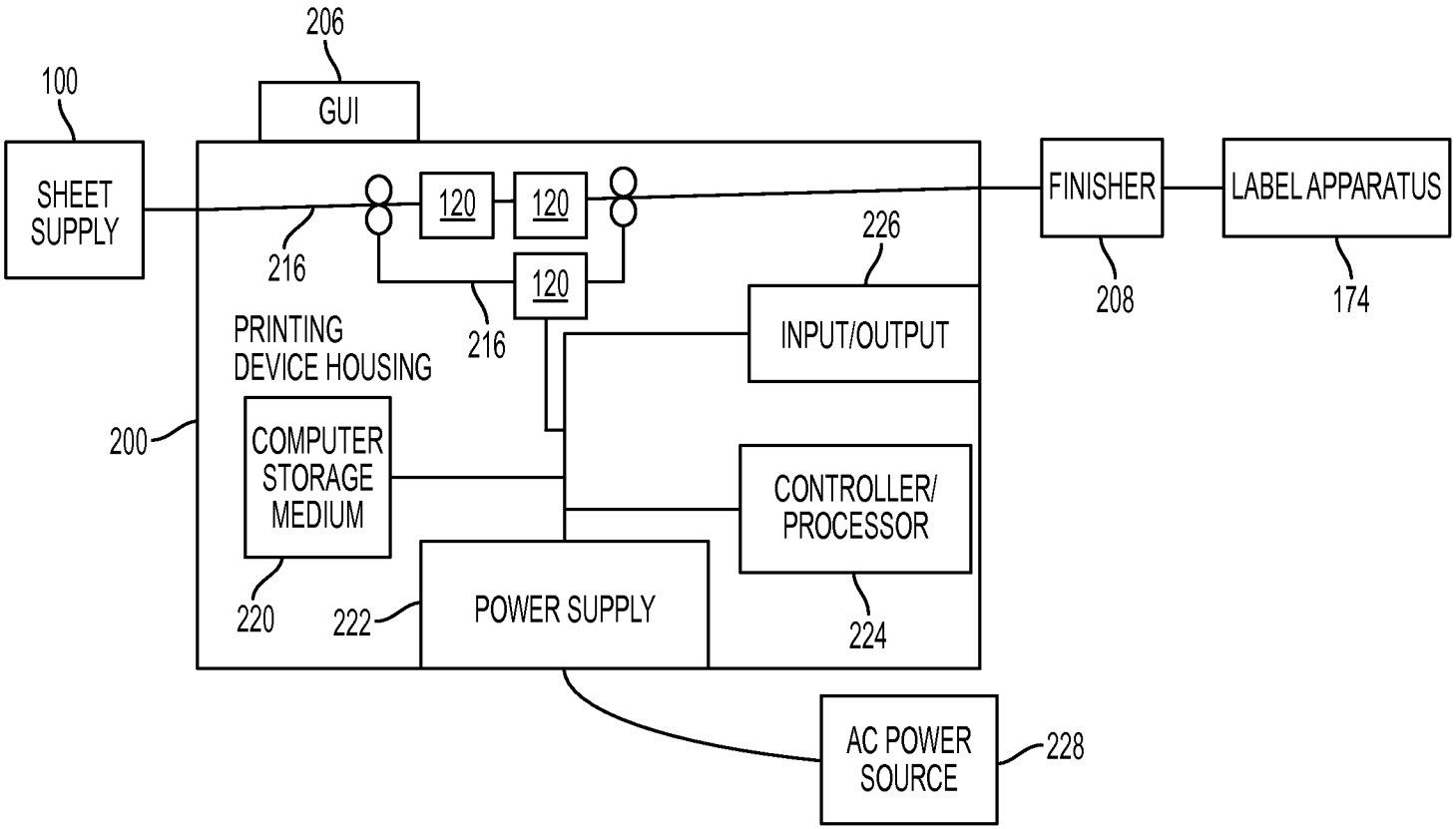
FIG. 5 is a side-view schematic diagram of a device according to embodiments herein.

FIG. 5 illustrates a computerized printing device 200, which can be used with embodiments herein and can comprise, for example, a printing press, modular printer, copier, multi-function machine, etc. The printing device 200 includes a controller/processor 224, at least one marking device (printing engine) 120 operatively connected to the processor 224, a media path 216 positioned to supply sheets of media from a sheet supply 100 to the marking device(s) 120 and a communications port (input/output) 226 operatively connected to the processor 224 and to a computerized network external to the printing device. After receiving various markings from the printing engine(s), the sheets of media can optionally pass to a finisher 208 and/or label apparatus 174 (as discussed above).

Also, the printing device 200 can include at least one accessory functional component, such as a graphic user interface assembly 206 that also operate on the power supplied from the external power source 228 (through the power supply 222).

The input/output device 226 is used for communications to and from the printing device 200. The processor 224 controls the various actions of the printing device. A non-transitory computer storage medium device 220 (which can be optical, magnetic, capacitor based, etc.) is readable by the processor 224 and stores instructions that the processor 224 executes to allow the printing device to perform its various functions, such as those described herein.

Thus, a printer body housing 200 has one or more functional components that operate on power supplied from the alternating current (AC) 228 by the power supply 222. The power supply 222 connects to an external alternating current power source 228 and converts the external power into the type of power needed by the various components.

Therefore, as shown in FIG. 1-5 discussed above, the devices herein have a sheet supply 100 that maintains sheets 108 of media. The sheet supply 100 comprises a number of sheet feeders 102-106 potentially containing different types and/or sizes of the sheets 108 of media. A processor 224 is operatively (meaning directly or indirectly) connected to the sheet supply 100. The processor 224 receives different print jobs and selects from among the sheet feeders depending on the types of sheets of media required by the print jobs. Further, the processor 224 causes this to happen continuously for each successive print job, without pausing for setup operations between each successive print job.

A digital printing device 120 is also operatively connected to the processor 224 and is positioned to receive the sheets 108 of media from the sheet supply 100. The digital printing device 120 places markings on the sheets 108 of media to produce printed labels 122. Again, the processor 224 controls the digital printing device 120 to print each successive print job continuously, also without manual intervention for setup operations between each successive print job.

Further, as referred to in all of the figures, one or more cutters 124 can be operatively connected to the processor 224. The cutter 124 cuts the sheets 108 of the printed labels 122 into individual labels 122 as controlled by the processor 224 (again, continuously for each successive print job, also without manual intervention for setup operations between each the successive print job). The cutter 124 can cut different patterns for each successive print job, similarly without manual intervention for setup operations between each successive print job.

An adhesive applicator 130 is positioned to apply adhesive to one side of the printed labels 122. (e.g., what can be arbitrarily referred to as the back of the printed labels 122). The adhesive applicator 130 can contact the back of the printed labels 122, or can be a spray applicator that sprays the adhesive on the back of the printed labels 122.

Further, a roll apparatus 140 is positioned to receive the printed labels 122 from the adhesive applicator 130. The roll apparatus 140 maintains one or more continuous supply rolls 146 of backing media 144. The roll apparatus 140 can position one of the continuous supply rolls 152-156 of backing media (if equipped with multiple backing rolls, as shown in FIG. 2) to receive the printed labels 122 from the adhesive applicator 130 continuously for each successive print job, without manual intervention for setup operations between each successive print job, as controlled by said processor 224. The roll apparatus 140 positions the backing media 144 to contact the back of the printed labels 122. The roll apparatus 140 can further comprise a pressure roller or a blade (142) that is positioned to press the labels 122 against the backing media. The roll apparatus 140 has a roll support maintaining a continuous roll 148 of the printed labels 122 attached to the backing media 144.

As mentioned above, the cutter 124 can be positioned between the digital printing device 120 and the adhesive applicator 130 to cut the sheets 108 of the printed labels 122 before the individual labels 122 are supplied to the adhesive applicator 130, and/or the cutter 124 can be positioned adjacent the roll apparatus 140 to cut the sheets 108 of the printed labels 122 after the individual labels 122 are attached to the backing media. Therefore, the devices herein can be used in many different environments including continuous media environments where the label media is cut into sheets 108 before printing, in environments where entire cut sheets 108 of labels 122 are attached to the backing media 144 (but where the labels 122 are separately cut (or scored) from the remainder (waste portion) of the cut sheets 108), in environments where only the labels 122 are attached to the backing media 144 (and the waste portion of the cut sheets is discarded), as well as other environments.

Therefore, as shown above, this system enables efficient short run printing of adhesive labels on a wide range of label media with minimal set up time. This lowers the cost of producing small numbers of labels, and also allows existing presses to be used for new purposes (such as label making)

without substantial modification. The devices herein increase the speed with which multiple label print jobs (that have different printing requirements and that use different media (and have labels different widths, sizes, shapes, etc.)) can be processed by allowing the different jobs to be handled continuously, without stopping for setup operations to change the label media or the backing media. Thus, the devices herein improve quality, reduce cost, and provide quicker processing.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, peripheral equipment is available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to all forms of digital printing, including electrophotographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An integrated apparatus comprising:

a sheet supply maintaining cut sheets of media;

a printing device positioned to receive said cut sheets of media from said sheet supply, said printing device placing markings on said cut sheets of media;

an adhesive applicator positioned to apply adhesive to one side of said media to produce labels;

a roll apparatus maintaining a continuous supply roll of backing media, said roll apparatus being positioned to receive said labels from said adhesive applicator, said backing media being positioned within said roll apparatus to contact said one side of said labels, and said roll apparatus comprising a translating carriage holding multiple backing media rolls having one of different widths and types of backing media.

2. The integrated apparatus of claim 1, wherein said roll apparatus receives said labels partially overlapped, such that said labels are partially overlapped on said backing media.

3. The integrated apparatus of claim 1, wherein said sheet supply comprises a plurality of sheet feeders containing a plurality of types of said sheets of media.

4. The integrated apparatus of claim 1, further comprising a cutter, said cutter cutting sheets of said labels into individual labels.

5. The integrated apparatus of claim 1, said roll apparatus further comprising one of a pressure roller and a blade positioned to press said labels against said backing media.

6. The integrated apparatus of claim 1, said roll apparatus comprising a continuous roll of said labels attached to said backing media.

7. An integrated apparatus comprising:

a sheet supply maintaining cut sheets of media;

a printing device positioned to receive said cut sheets of media from said sheet supply, said printing device placing markings on said cut sheets of media;

an adhesive applicator positioned to apply adhesive to one side of said media to produce labels; and a roll apparatus maintaining a continuous supply roll of backing media, said roll apparatus being positioned to receive said labels from said adhesive applicator, said backing media being positioned within said roll apparatus to contact said one side of said labels, and said roll apparatus comprising a plurality of rolls of backing media and a translating carriage positioning a selected roll of backing media into a position to receive said media from said adhesive applicator.

8. The integrated apparatus of claim 7, further comprising a controller, said plurality of rolls of backing media being of different widths and different types, and said controller automatically selecting and positioning the appropriate roll of backing media depending on at least one of size and application requirements of said labels being printed.

9. The integrated apparatus of claim 7, wherein said roll apparatus receives said labels partially overlapped, such that said labels are partially overlapped on said backing media.

10. The integrated apparatus of claim 7, wherein said sheet supply comprises a plurality of sheet feeders containing a plurality of types of said sheets of media.

11. The integrated apparatus of claim 7, further comprising a cutter, said cutter cutting sheets of said labels into individual labels.

12. The integrated apparatus of claim 7, said roll apparatus further comprising one of a pressure roller and a blade positioned to press said labels against said backing media.

13. The integrated apparatus of claim 7, said roll apparatus comprising a continuous roll of said labels attached to said backing media.

14. An integrated apparatus comprising:

a sheet supply maintaining cut sheets of media;

a printing device positioned to receive said cut sheets of media from said sheet supply, said printing device placing markings on said cut sheets of media;

an adhesive applicator positioned to apply adhesive to one side of said media to produce labels; and a roll apparatus maintaining a continuous supply roll of backing media, said roll apparatus being positioned to receive said labels from said adhesive applicator, said backing media being positioned within said roll apparatus to contact said one side of said labels, said roll apparatus comprising a translating carriage holding multiple backing media rolls having one of different widths and types of backing media, and said translating carriage moving different backing substrates within said roll apparatus to contact said one side of said labels to attach said labels to different ones of multiple backing media rolls.

15. The integrated apparatus of claim 14, wherein said roll apparatus receives said labels partially overlapped, such that said labels are partially overlapped on said backing media.

16. The integrated apparatus of claim 14, wherein said sheet supply comprises a plurality of sheet feeders containing a plurality of types of said sheets of media.

17. The integrated apparatus of claim 14, further comprising a cutter, said cutter cutting sheets of said labels into individual labels.

18. The integrated apparatus of claim 14, said roll apparatus further comprising one of a pressure roller and a blade positioned to press said labels against said backing media.

19. The integrated apparatus of claim 14, said roll apparatus comprising a continuous roll of said labels attached to said backing media.

* * * * *